United States Patent [19]

Forschirm

[11] 4,063,887

[45] Dec. 20, 1977

[54] METHOD FOR IMPROVING THE WATER ABSORPTION OF POLYESTER FIBERS

[75] Inventor: Alex S. Forschirm, Lake Hiawatha, N.J.

[73] Assignee: Celanese Corporation, New York, N.Y.

[21] Appl. No.: 707,588

[22] Filed: July 22, 1976

[51] Int. Cl.[2] ..... D06M 5/02; D06M 9/04

[52] U.S. Cl. ..... 8/130.1; 8/115.5; 8/115.7; 8/DIG. 4

[58] Field of Search ..... 8/115.5, 115.7, 194, 8/196, 130.1, DIG. 4

[56] References Cited

U.S. PATENT DOCUMENTS

| | | | |
|---|---|---|---|
| 3,661,501 | 5/1972 | Corbett et al. | 8/115.5 |
| 3,795,480 | 3/1974 | Harper et al. | 8/18 |
| 3,807,946 | 4/1974 | Harper et al. | 8/18 |
| 3,867,479 | 2/1975 | Spanninger | 260/860 |
| 3,872,183 | 3/1975 | Keck | 260/860 |

*Primary Examiner*—John Kight, III

[57] ABSTRACT

The water absorbency of normally hydrophobic polyester fibers is improved by contacting (e.g., by immersing) these fibers in an aqueous solution of a hydroxyamine selected from the group consisting of monohydroxyamines, dihydroxyamines, and trihydroxyamines, and mixtures thereof.

35 Claims, No Drawings

METHOD FOR IMPROVING THE WATER ABSORPTION OF POLYESTER FIBERS

BACKGROUND OF THE INVENTION

Polyester fibers are normally hydrophobic, and resist the absorption of water into the fabric structure. This can lead to feelings of clamminess and discomfort, particularly in humid weather.

In some instances this problem may be overcome by providing a fabric which comprises a blend of polyester and cellulosic material, such as cotton. Modern methods utilized to impart wash resistant, and wrinkle resistant finishes to such blended material include the application of resinous coatings to the cotton fibers which react with hydroxyl groups on the cellulose molecules. One effect of these coatings is to render the normally hydrophilic cotton fibers hydrophobic thereby reducing the ability of these fibers to absorb water. These resinous coatings, however, do not affect the polyester fibers of the blend. Thus, if the polyester fibers can be rendered hydrophilic the loss of water absorbent properties by the cotton fibers can be compensated for by the increase in water absorbant properties of the polyester fibers.

Hydroxyamines of the type utilized in this invention have been utilized in the past to impart acidic dye receptivity to both polyester and cotton fibers as evidenced by the following U.S. Pat. Nos. 3,867,479; 3,807,946; and 3,795,480. Nonhydroxy-amines have also been utilized for the same purpose as mentioned in U.S. Pat. No. 3,432,467. None of these patents, however, recognize that such hydroxyamines may be utilized in a pad bath in accordance with the present invention to impart increased water absorbency to the treated polyester fibers.

It is therefore an object of the present invention to provide a process for increasing the water absorbency of polyester fibers.

It is a further object of the present invention to provide a process for increasing the water absorbency of fabrics made from polyester fibers.

It is a further object of the present invention to provide a process for improving the water absorbency of a material comprising a blend of polyester fibers and cotton fibers which cotton fibers have been rendered and substantially hydrophobic.

These and other objects as well as the scope, nature and utilization of the claimed invention will be apparent from the following detailed description and appended claims.

SUMMARY OF THE INVENTION

In one aspect of the presently claimed invention there is provided a process for improving the water absorbency of polyester fibers which comprises contacting said polyester fibers with an aqueous solution of a hydroxyamine selected from the group consisting of monohydroxyamines, dihydroxyamines, and trihydroxyamines and mixtures thereof and having a pH of at least 7.

In another aspect of the presently claimed invention there is provided a process for improving the water absorbency of polyester fibers which comprises contacting said polyester fibers with an aqueous solution of a hydroxyamine selected from the group consisting of monohydroxyamines, dihydroxyamines, and trihydroxyamines, and mixtures thereof and having a pH of at least 7 while at a temperature in excess of the boiling point of water and below the temperature at which the properties of the fibers are deleteriously influenced, and at a pressure in excess of atmospheric pressure.

In still another aspect of the presently claimed invention there is provided a process for improving the water absorbency of a fabric comprising polyester fibers containing 85 to 100 mole percent polyethylene terephthalate and 0 to 15 mole percent of copolymerized ester units other then the polyethylene terephthalate which comprises contacting said fabric with an aqueous solution of a hydroxyamine selected from the group consisting of monohydroxyamines, trihydroxyamines and dihydroxyamines and mixtures thereof and having a pH of at least 7, by immersing said fabric in said aqueous solution below the temperature at which the properties of the fabric are deleteriously influenced.

DESCRIPTION OF THE PREFERRED EMBODIMENTS

The expression "polyester" as used herein refers to the polymeric condensation products of dihydric alcohols with organic acids, particularly dicarboxylic acids as well as monohydroxy carboxylic acids, which have been formed into fibers.

The expression "polyester" also includes copolyester fibers such, for example, as those which comprise at least from about 85 to 100 mole percent polyethylene terephthalate and from about 0 to 15 mole percent copolymerized ester units other than polyethylene terephthalate.

Thus, the basic structures of the polymers utilized in the present invention are polyester or copolyester fibers such as those prepared from polyalkylene terephthalate, polycycloalkylene terephthalate, polyalkylene naphthalate, polycycloalkylene naphthalate.

These polyester fibers can be derived from dicarboxylic acids or ester forming derivatives thereof and glycols or ester forming derivatives thereof. Representative examples of dicarboxylic acids from which the polyesters may be derived include aromatic dicarboxylic acids such as terephthalic, isophthalic and other phthalic acids, naphthalene-dicarboxylic, diphenyldicarboxylic and mixtures thereof; aliphatic dicarboxylic acids such as adipic acid, sebacic acid, azelaic acid, and mixtures thereof. Suitable monohydroxy carboxylic acids include p-(Beta-hydroxyethoxy) benzoic acid and the like.

Suitable glycols from which the polyesters of the present invention may be made include ethylene glycol, propylene glycol, tetramethylene glycol, hexamethylene glycol, neopentylene glycol, 1,4-cyclohexane dimethanol, 1,4-cyclohexane diol, 1,4-bishydroxyethoxybenzene, bisphenol A, and mixtures thereof.

Preferred polyester fibers representative of the present invention include those prepared from polyethylene terephthalate and 1,4-cyclohexanedimethanol terephthalate (KODEL TM)

Generally, insofar as suitable technical apparatus is available, the process of the present invention may preferably be performed upon the polyester fiber while possessing any configuration which is also suitable for any of the dispersed dyeing processes generally known to those skilled in the art. For example, the polyester fibers may be in the form of slubbing, tow, yarn or fabric. The term "fabric" as used herein includes the knitted, woven, and nonwoven variety.

The preferred configuration of the polyester fibers utilized in the present invention comprises a fabric as hereinabove described. The polyester fibers forming the fabric preferably comprise polyethylene terephthalate, however minor amounts of other copolyester units such as those derived from the acids, and glycols mentioned above may also be incorporated.

Mixed fabrics, such as those made from a blend of cotton and polyester fibers such as polyalkylene terephthalate may be subjected to process conditions which render the cotton fibers contained therein hydrophobic such as those fabrics which have had permanent press properties imparted thereto may also be utilized in accordance with the present process. Such permanent press properties may be imparted by any manner known to those skilled in the art such as by padding the mixed fabric with an aqueous dispersion of about 0.1 to about 0.5% nonionic wetting agent, derived from alkylphenoxypoly(oxyethylene) ethanols such as IGEPAL 430 TM, 25% of a carbamate or glyoxal resin, 5 to 7% of a solution of a suitable catalyst such as magnesium chloride or zinc nitrate, and 1 to 3% of a polyethylene emulsion such as CYANOLUBE 40 TM. Other ingredients such as 3 to 6% of an acrylic hand builder, optical brightener, and tint may also be added to the dispersion. The fabric is dryed at about 105° to 110° C for about 3 minutes and cured at 185° to 195° C. for one minute. For a further discussion of permanent press treatment see U.S. Pat. No. 2,957,746 which is herein incorporated by reference.

The mixed cotton:polyester fabrics which may be utilized in accordance with the present process may comprise about 35%, preferably about 50%, and most preferably about 65% polyester fibers and correspondingly about 65%, preferably about 50%, and most preferably about 35% cotton fibers.

Suitable hydroxyamines which may be utilized in the practice of the present invention include monohydroxyamines, dihydroxyamines trihydroxyamines, and mixtures thereof.

Suitable monohydroxyamines which may be utilized in the practice of the present invention are represented by the general formula

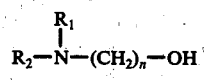

wherein $R_1$ and $R_2$ is a radical selected from the group consisting of alkyl, aryl, aralkyl, alkaryl and hydrogen, and n is an integer having a value from 1 to 10. Representative examples of alkyl radicals in the above formula include radicals such as methyl, ethyl, isopropyl, propyl, isobutyl, t-butyl, butyl, pentyl, hexyl, heptyl, octyl, and steryl; suitable aryl radicals include phenyl, and naphthyl; aralkyl radicals include benzyl and phenethyl; alkaryl radicals include ethylphenol; cycloalkyl radicals include cyclohexyl, cyclododecyl.

Suitable examples of monohydroxyamines include; 2-diethylaminoethanol, ethanolamine, 2-cyclohexylamino-1-ethanol, 2(N-ethylanilino)-1-ethanol, N-ethyl-N-benzyl-ethanolamine, 3-diethylamino-1-propanol, 3-diethylamino-2,2-dimethyl-1-propanol, 3-diethylamino-2,2-dimethyl-1-propanol, 3-(2-pyridyl)-1-propanol, N-dibutyl glycolamine, 4-diethylamino-1-butanol, beta-(diethylaminoethoxy) ethanol, 3-(3-pyridyl methylamino)-1-propanol, 2-[2-(p-tolyloxy)-ethylamino]ethanol, N-ethyl-ethanolamine, N-ethyl-N-cyclohexyl-1-ethanolamine, N-ethyl-N-phenyl-1-ethanolamine, N-ethyl-N-tolyl-1-ethanolamine, N,N-dicyclohexyl-1-ethanolamine, N-cyclohexyl-N-phenyl-1-ethanolamine, N-cyclohexyl-N-tolyl-1-ethanolamine, N-cyclohexyl-N-benzyl-1-ethanolamine, N,N-diphenylamino-1-ethanol, N-phenyl-N-tolyl-1-ethanolamine, N-phenyl-N-benzyl-1-ethanolamine, N-phenyl-N-2-pyridyl-1-ethanolamine, N,N-ditolyl-1-ethanolamine, N-tolyl-N-2-pyridylamino-1-ethanol, N-benzyl-1-ethanolamine, N,N-dibenzylamino-1-ethanol, N-benzyl-N-2-pyridylamino-1-ethanol and N,N-di(2-pyridyl-)amino-1-ethanol.

Suitable dihydroxyamines utilized in the present invention have the general formula

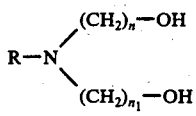

wherein R is a radical selected from the group consisting of hydrogen, alkyl, aryl, aralkyl, alkaryl, cycloalkyl, $n$ and $n_1$ are intergers from 1 to 10. Representative examples of alkyl radicals in the above formula include radicals such as methyl, ethyl, isopropyl, propyl, isobutyl, t-butyl, butyl, pentyl, hexyl, heptyl, octyl, and steryl; suitable aryl radicals include phenyl, and naphthyl; aralkyl radicals include benzyl and phenethyl; alkaryl radicals include ethylphenol; cycloakyl radicals include cyclohexyl, cyclododecyl.

Representatives of dihydroxyamines of the class described above are N-substituted dialkanol amines such as the N-substituted diethanol amines, N-substituted dipropanol amines, N-substituted dibutanol amines, N-substituted dihexanol amines.

Specific examples of such amines include N-methyl diethanol amine, N-ethyl diethanol amine, N-propyl diethanol amine, N-butyl diethanol amine, N-hexyl diethanol amine, N-phenyl diethanol amine, N-naphthyl diethanol amine, N-benzyl diethanol amine, N-phenylethyl diethanol amine, N-ethylphenyl diethanol amine.

Suitable trihydroxyamines utilized in the present invention have the general formula:

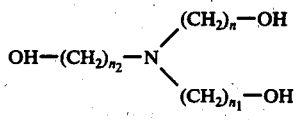

wherein $n$, $n_1$, and $n_2$, are integers from 1 to 10.

Trihydroxyamines suitable for the practice of the present invention include triethanol amine, tributanol amine, tripropanol amine, and the like.

The preferred hydroxyamines include ethanolamine, diethanolamine, 2-diethylaminoethanol, and triethanolamine.

The process of the present invention is carried out by contacting the polester fibers described above preferably in the form of a knitted, woven or nonwoven fabric with an aqueous solution of a hydroxyamine or mixtures thereof below the temperature at which the properties of the fiber are deleteriously influenced. More specifically several yards of said fabric may be looped on a frame, washed in hot water to remove oils, and immersed in said aqueous solution. The immersion is continued for a period sufficient to apply the hydroxyamine to the polyester fibers in an amount which may vary from about 0.01 gram to about 2 grams, preferably from about 0.1 gram to about 1 gram and most preferably from about 0.3 gram to about 0.7 gram per 100 grams of polyester fiber. Said period may vary from about 0.5 to about 3 hours, preferably from about 1 to about 3 hours and most preferably from about 1 to about 2 hours.

The aqueous solution may be prepared by dissolving into a liter of water an amount of hydroxyamines which may vary from about 0.5 grams to about 5 grams, preferably from about 2.0 grams to about 4.0 grams, and most preferably from about 2.5 grams to about 3.5 grams.

The temperature at which the immmersion takes place may vary from about 20° to about 140° C, preferably from about 70° to about 130° C and most preferably from about 80° to about 120° C and should not exceed the temperature at which the fibers begin to deteriorate.

The pH at which the immersion takes place must be at least 7.0 and preferably 7.0 to about 9.0. Such a pH is helpful to avoid any possible transesterification or transamidation reactions which might occur between the amine salt, which may form at a pH lower than 7, and the polyester.

Generally the immersion takes place at atmospheric pressure, however, when the process is carried out in water above its normal boiling point (i.e. in excess of 100° C) the immersion may take place in a sealed container and the pressure applied during the immersion is sufficient to keep the aqueous solution in the liquid state at the elevated temperatures and may vary from about 15 to about 55 psi, preferably from about 20 to about 40 psi and most preferably from about 25 to about 35 psi (e.g. 30 psi).

In a commercial embodiment it is preferred to add the hydroxyamines to an aqueous dispersed dye bath and immerse the fabric in said bath under conditions of temperature and pressure and pH described above although the hydroxy amines may be added before or after dyeing. The fabric may therefore by dyed and treated in accordance with the present invention simultaneously thereby eliminating the necessity of providing an additional step.

Where the fabric comprises the blend of polyester and cotton the process of the present invention may be performed either before or after the fabric is treated with materials which impart permanent press properties to the fabric.

The polyester fibers and fabrics provided therefrom which are treated in accordance with the present invention are useful in providing wearing apparel and particularly wearing apparel which has contact with the skin such as diaper filling. Such processes may also be utilized to provide improved soil and stain release.

An additional benefit of the present process is a noted increase in the receptivity of the treated polyester fiber to disperse dyes.

The following examples are given as specific illustrations of the claimed invention. It should be understood, however, that the invention is not limited to the specific details set forth in the examples.

EXAMPLE I

A 100% polyethylene terephthalate polyester fabric weighing 7.7 ounces per square yard is first washed three times in clear hot water in a washing machine to remove oils. Then four swatches of about 2 grams each are cut out and placed in separate pressure containers with 80 grams of water. 0.2 grams each of either ethanolamine, diethanolamine, or 2-diethyl-aminoethanol are added to the first three containers respectively yielding solutions having a pH of about 7 to about 9. The fourth container contains water and no additives and serves as a control. The containers are sealed and heated in a water bath at 120° C for 2 hours. The samples are removed, washed one time in clear hot water in a washing machine, and tumble dried.

The water absorptivity of the samples is tested by allowing a drop of water to fall from a dropper onto the fabric which is on a flat surface. Such test is similar to the procedure outlined in the A.A.T.C.C. wettability test 39-1971. The time is noted at the initial contact of the drop with the fabric and again upon disappearance of the drop as determined by an observer. The swatches are then washed successively in clear water and tested after 4, 6, 8, 10 and 12 washings. The results of the tests are given in Table I.

Table 1

Water Absorption into 100% Woven Polyethylene Terephthalate Polyester Fabrics

| | Water Absorption - Seconds No. of Clear Water Washings | | | | | |
|---|---|---|---|---|---|---|
| Treatment | 1X | 4X | 6X | 8X | 10X | 12X |
| None | 210 | 210 | 270 | 300 | 360 | 900 |
| Ethanolamine | Inst. | Inst. | 30 | 10 | 30 | 20 |
| Diethanolamine | 20 | 20 | 60 | 40 | 80 | 90 |
| 2-Diethylaminoethanol | Inst. | Inst. | Inst. | Inst. | 5 | 8 |

Inst. = Instaneous

EXAMPLE II

A 100% polyethylene terephthalate fabric averaging 8.5 oz/yd$^2$ is cut into 8 swatches, each measuring approximately 3 × 3 inches and weighing 1.7 grams. The swatches are first washed 3 times in clear hot water in a washing machine to remove oils. Then each swatch is placed in a separate container with 80 ml. of water. 0.17 grams (i.e., 10% by weight of fabric plus additive) of 2-diethylaminoethaol (DEAE) is added to 4 of these containers yielding a solution having a pH of about 7 to 9 the remainder serving as a control. The containers are sealed and two containers are heated to 60° C for 30 and 60 minutes respectively together with their control while the other two containers together are heated at 120° C for 30 and 60 minutes respectively, after which the swatches are removed, washed one time in clear hot water in a washing machine, and tumble dried.

The swatches are tested in accordance with the water absorption test procedures outlined in Example I and are then washed 6 times in clear hot water and tested again. The results are given in Table II. As may be seen from the results presented therein a treatment temperature of 120° C yields substantially better results than a treatment temperature of 60° C while at both temperatures the 10% DEAE additive substantially improves water absorption over that of the control.

TABLE II

Water Absorption by 100% Woven Polyethylene Terephthalate Polyester fabric

| Treatment Temp. | No. of Clear Washes | Treatment Time | 10% DEAE Water Absorption - Seconds | Control Water Absorption - Seconds |
|---|---|---|---|---|
| 60° C | | | | |
| | | 30 min. | | |
| | 1X | | 155 | 196 |
| | 6X | | 91 | 131 |
| | | 60 min. | | |
| | 1X | | 70 | 168 |

TABLE II-continued

Water Absorption by 100% Woven Polyethylene Terephthalate Polyester fabric

| Treatment Temp. | No. of Clear Washes | Treatment Time | 10% DEAE Water Absorption - Seconds | Control Water Absorption - Seconds |
|---|---|---|---|---|
| 120° C | 6X | | 55 | 114 |
| | | 30 min. | | |
| | 1X | | 5 | 9 |
| | 6X | | 8 | 25 |
| | | 60 min. | | |
| | 1X | | 1 | 7 |
| | 6X | | 2 | 22 |

*DEAE = 2-diethylamino ethanol

EXAMPLE III

A polyester fiber derived from poly 1,4-cyclohexanedimethanol terephthalate (i.e., KODEL TM) is provided in the form of a fabric. The fabric is then treated in accordance with the procedures outlined in Example II. The treated fabric shows improved water absorbency over that of the control.

Although the invention has been described with preferred embodiments, it is to be understood that variations and modifications may be resorted to as will be apparent to those skilled in the art. Such variations and modifications are to be considered within the purview and the scope of the claims appended hereto.

I claim:

1. A process for improving the water absorbency of polyester fibers which comprises contacting said polyester fibers at a temperature of from about 20° to about 140° C with an aqueous solution of a hydroxyamine selected from the group consisting of monohydroxyamines, dihydroxyamines, and trihydroxyamines and mixtures thereof and having a pH of at least 7.

2. The process for improving the water absorbency of polyester fibers of claim 1 wherein the hydroxyamine is 2-diethylaminoethanol.

3. The process for improving the water absorbency of polyester fibers of claim 1 wherein the hydroxyamine is diethanolamine.

4. The process for improving the water absorbency of polyester fibers of claim 1 wherein the hydroxyamine is triethanolamine.

5. The process for improving the water absorbency of polyester fibers of claim 1 wherein the hydroxyamine is ethanolamine.

6. The process for improving the water absorbency of polyester fibers of claim 1 wherein the polyester contains from about 85 to 100 mole percent polyethylene terephthalate and 0 to 15 mole percent of copolymerized ester units other than polyethylene terephthalate.

7. The process for improving the water absorbency of polyester fibers of claim 1 wherein the polyester is substantially polyethylene terephthalate.

8. The process for improving the water absorbency of polyester fibers of claim 1 wherein the polyester is poly-1,4-cyclohexane dimethanol terephthalate.

9. The process for improving the water absorbency of polyester fibers of claim 1 wherein the temperature of said aqueous solution at the time of said contact is from about 70 to about 130° C.

10. The process for improving the water absorbency of polyester fibers of claim 1 wherein the polyester fibers are in fabric form when contacted with said solution.

11. The process for improving the water absorbency of polyester fibers of claim 1 wherein the polyester fibers are immersed in an aqueous solution having a pH of about 7 to about 9 at a temperature of from about 80° to about 120° C.

12. The process for improving the water absorbency of the polyester fibers of claim 1 wherein the polyester fibers are polyethylene terephthalate and at the time of said contact with said aqueous solution are blended with cotton fibers.

13. A process for improving the water absorbency of polyester fibers which comprises contacting said polyester fibers with an aqueous solution of a hydroxyamine selected from the group consisting of monohydroxyamines, dihydroxyamines, and trihydroxyamines and mixtures thereof and having a pH of at least 7.0, while at a temperature in excess of the boiling point of water and below the temperature at which the properties of the fiber are deleteriously influenced and at a pressure in excess of atmospheric pressure.

14. The process for improving the water absorbency of polyester fibers of claim 13 wherein the hydroxyamine is 2-diethylaminoethanol.

15. The process for improving the water absorbency of polyester fibers of claim 13 wherein the hydroxyamine is diethanolamine.

16. The process for improving the water absorbency of polyester fibers of claim 13 wherein the hydroxyamine is triethanolamine.

17. The process for improving the water absorbency of polyester fibers of claim 13 wherein the hydroxyamine is ethanolamine.

18. The process for improving the water absorbency of polyester fibers of claim 13 wherein the polyester contains from about 85 to 100 mole percent polyethylene terephthalate and 0 to 15 mole percent of copolymerized ester units other than polyethylene terephthalate.

19. The process for improving the water absorbency of polyester fibers of claim 13 wherein the polyester is substantially polyethylene terephthalate.

20. The process for improving the water absorbency of polyester fibers of claim 13, wherein the polyester is poly-1,4-cyclohexane diemthanol terephthalate.

21. The process for improving the water absorbency of polyester fibers of claim 13 wherein the temperature of said aqueous solution at the time of said contact close does not exceed about 140° C.

22. The process for improving the water absorbency of polyester fibers of claim 13 wherein said aqueous solution at the time of said contact is maintained at a pressure of about 15 psi to about 55 psi.

23. The process for improving the water absorbency of polyester fibers of claim 13 wherein the polyester fibers are in fabric form when contacted with said solution.

24. The process for improving the water absorbency of polyester fibers of claim 13 wherein the polyester fibers are immersed in said aqueous solution having a pH of about 7.0 to about 9.0.

25. The process for improving the water absorbency of the polyester fibers of claim 13 wherein the polyester fibers are polyethylene terephthalate and at the time of said contact with said aqueous solution are blended with cotton fibers.

26. The process for improving the water absorbency of polyester fibers of claim 13 wherein the polyester fibers are contacted with said aqueous solution for a period of about 2 hours while at a temperature of about 120° C and at a pressure of about 30 psi.

27. A process for improving the water absorbency of a fabric comprising polyester fibers containing 85 to 100 mole percent polyethylene terephthalate and 0 to 15 mole percent of copolymerized ester units other than the polyethylene terephthalate which comprises contacting said fabric with an aqueous solution of a hydroxyamine selected from the group consisting of monohydroxyamines, dihydroxyamines, and trihydroxyamines and mixtures thereof and having a pH of at least 7.0, by immersing said fabric in said aqueous solution at a temperature of from about 20° to about 140° C.

28. The process for improving the water absorbency of the fabric of claim 27 wherein the hydroxyamine is diethanolamine.

29. The process for improving the water absorbency of the fabric of claim 27 wherein the hydroxyamine is diethanolamine.

30. The process for improving the water absorbency of the fabric of claim 27 wherein the hydroxyamine is triethanolamine.

31. The process for improving the water absorbency of the fabric of claim 27 wherein the hydroxyamine is ethanolamine.

32. The process for improving the water absorbency of the fabric of claim 27 wherein the fabric comprises from 0 to 15 mole percent of poly 1,4-cyclohexane dimethanol terephthalate.

33. The process for improving the water absorbency of the fabric of claim 27 wherein the polyester fibers of said fabric are blended with cotton fibers.

34. The process for improving the water absorbency of the fabric of claim 27 wherein said fabric is immersed in said aqueous solution of hydroxyamine at a temperature of from about 70° to about 130° C.

35. The process for improving the water absorbency of the fabric of claim 27 wherein said fabric is immersed in said aqueous solution of hydroxyamine at a temperature of from about 80° to about 120° C.

* * * * *